US008408184B2

(12) United States Patent
Marc et al.

(10) Patent No.: US 8,408,184 B2
(45) Date of Patent: Apr. 2, 2013

(54) FASTENING ELEMENT AND FLUID INJECTOR ASSEMBLY

(75) Inventors: Daniel Marc, Leghorn (IT); Giandomenico Serra, Pisa (IT); Matteo Soriani, Leghorn (IT); Rita Ventisette, Ponte a Egola (IT)

(73) Assignee: Continental Automotive GmbH, Hannover (DE)

( * ) Notice: Subject to any disclaimer, the term of this patent is extended or adjusted under 35 U.S.C. 154(b) by 508 days.

(21) Appl. No.: 12/707,727

(22) Filed: Feb. 18, 2010

(65) Prior Publication Data

US 2010/0218743 A1 Sep. 2, 2010

(30) Foreign Application Priority Data

Feb. 18, 2009 (EP) ..... 09002289

(51) Int. Cl.
*F02M 61/14* (2006.01)

(52) U.S. Cl. ..... 123/470; 123/456

(58) Field of Classification Search ..... 123/456, 123/468–470; 29/890.124, 525.01; 239/533.2, 239/600; 24/295, 339, 457, 669
See application file for complete search history.

(56) References Cited

U.S. PATENT DOCUMENTS

| | | | | |
|---|---|---|---|---|
| 5,136,999 | A | 8/1992 | Bassler et al. | 123/470 |
| 5,724,946 | A * | 3/1998 | Franchitto | 123/470 |
| 5,893,351 | A * | 4/1999 | Akutagawa et al. | 123/470 |
| 5,970,953 | A * | 10/1999 | Lorraine et al. | 123/470 |
| 6,481,420 | B1 * | 11/2002 | Panasuk et al. | 123/470 |
| 2003/0056759 | A1 * | 3/2003 | Davey | 123/456 |
| 2003/0183200 | A1 | 10/2003 | Bugos | 123/470 |
| 2004/0045530 | A1 | 3/2004 | Schoeffler | 123/457 |
| 2006/0124110 | A1 | 6/2006 | Schoeffler | 123/457 |
| 2007/0266996 | A1 | 11/2007 | Zdroik et al. | 123/445 |
| 2009/0056674 | A1 | 3/2009 | Furst et al. | 123/470 |

FOREIGN PATENT DOCUMENTS

| | | |
|---|---|---|
| DE | 20104270 | 7/2002 |
| DE | 102004048401 | 4/2006 |
| EP | 1703121 | 9/2006 |
| EP | 1892408 | 2/2008 |
| WO | 9015240 | 12/1990 |

OTHER PUBLICATIONS

European Search Report for Application No. 09002289.8 (4 pages), Jul. 22, 2009.

* cited by examiner

*Primary Examiner* — John T. Kwon
*Assistant Examiner* — Johnny Hoang
(74) *Attorney, Agent, or Firm* — King & Spalding L.L.P.

(57) ABSTRACT

A Fastening element has a carrier. A first pair of prongs branches off a first side face of the carrier designed to be in a mechanical engagement with a protrusion of a injector cup. A second pair of prongs branches off a second side face of the carrier. The second pair of prongs is designed to retain a fluid injector and to couple mechanically to a first protrusion of the injector. A pair of pins branches off a respective prong from the second pair of prongs at a respective inner side face of the respective prong. The pins are arranged opposed to each other and in a given distance from each other and they are designed to be in a mechanical engagement with the fluid injector. A clamping device being designed to couple mechanically with the fluid injector cup and to exert a repelling force on the fluid injector cup.

18 Claims, 4 Drawing Sheets

FASTENING ELEMENT AND FLUID INJECTOR ASSEMBLY

CROSS-REFERENCE TO RELATED APPLICATIONS

This application claims priority to EP Patent Application No. 09002289 filed Feb. 18, 2009, the contents of which is incorporated herein by reference in its entirety.

TECHNICAL FIELD

The present invention concerns a fastening element and fluid injector assembly

BACKGROUND

In order to keep pressure fluctuations during the operation in an internal combustion engine at a low level, the internal combustion engine can be equipped with a fuel accumulator to which fuel injectors are hydraulically coupled and which has a relatively large volume. Such a fuel accumulator is often referred to as a fuel rail. The fuel rail supplies the fuel from a fuel tank via a low or high pressure fuel pump to the fuel injectors.

Fuel rails comprise a hollow body with recesses in form of cups which are also known as fuel injector cups. The fuel injector cups are hydraulically coupled to the fuel injectors. The connection between the fuel injectors and the fuel injector cups of the fuel rail needs to be very precise in order to mount the fuel injectors in a correct injection angle.

The EP 1 703 121 A1 discloses a clip that is suitable for connecting and positioning a fuel injector to a fuel rail comprising a first recess being designed for retaining a fuel injector, comprising a second recess that communicates with the first recess being designed for retaining an injector guide which is connected to the fuel injector and comprising a third recess being designed for retaining a cup guide of a cup of the fuel rail.

SUMMARY

According to various embodiments, a fastening element and a fluid injector assembly can be created which are simple and at the same time contribute to a precise and reliable connection and positioning of a fluid injector relative to a fluid injector cup.

According to various embodiments, a fastening element may comprise a carrier, a first pair of prongs branching off a first side face of the carrier being designed to be in a mechanical engagement with a protrusion of a fluid injector cup, a second pair of prongs branching off a second side face of the carrier is designed to retain a fluid injector and to couple mechanically to a first protrusion of the fluid injector, a pair of pins branching off a respective prong from the second pair of prongs at a respective inner side face of the respective prong such that the pins are arranged opposed to each other and in a given distance from each other and that they are designed to be in a mechanical engagement with the fluid injector, and a clamping device being designed to couple mechanically with the fluid injector cup and to exert a repelling force on the fluid injector cup.

According to a further embodiment, the clamping device may comprise a third pair of prongs branching off the first side face of the carrier in a given angle and being designed to retain the fluid injector cup. According to a further embodiment, the prongs of the first pair of prongs may comprise a respective projection at the end of a respective free and are designed to couple to the protrusion of the fluid injector cup in a snap fit engagement. According to a further embodiment, the given angle can be about 90°. According to a further embodiment, the fastening element can be made of stainless steel.

According to yet another embodiment, a fluid injector assembly may comprising such a fastening element and further may comprise a fluid injector cup with a protrusion, and a fluid injector with a housing having a first protrusion and an second protrusion, wherein the fastening element is mechanically connected with the fluid injector cup and the fluid injector such that the protrusion of the fluid injector cup is in a mechanical engagement with the first pair of prongs, the first protrusion of the housing is mechanically coupled to the second pair of prongs and is arranged between the two prongs of the second pair of prongs and the second protrusion is in a mechanical engagement with the pair of pins.

According to yet another embodiment, a fluid injector assembly may comprise a fastening element as described above and may further comprise a fluid injector cup with a protrusion, a fluid injector being hydraulically coupled to the fluid injector cup and having a housing with a first protrusion and a notch, wherein the fastening element is mechanically connected with the fluid injector cup and the fluid injector such that the protrusion of the fluid injector cup is in a mechanical engagement with the first pair of prongs, the first protrusion of the housing is mechanically coupled to the second pair of prongs and is arranged between the two prongs of the second pair of prongs and the pair of pins is mechanically coupled with a respective lateral side face of the notch.

BRIEF DESCRIPTION OF THE DRAWINGS

Exemplary embodiments are explained in the following with the aid of schematic drawings. These are as follows.

Figure 1:
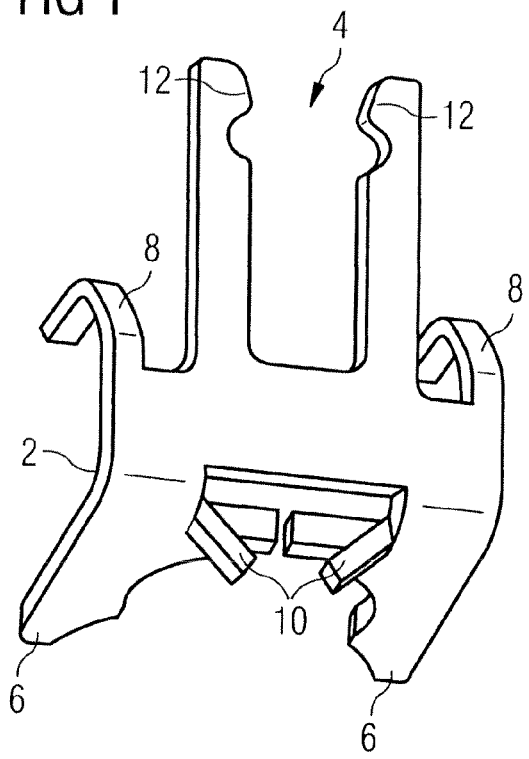
FIG. 1 a fastening element.

Elements of the same design or function that occur in different illustrations are identified by the same reference signs.

DETAILED DESCRIPTION

According to a first aspect, a fastening element may comprise a carrier. A first pair of prongs branching off a first side face of the carrier is designed to be in a mechanical engagement with a protrusion of a fluid injector cup. A second pair of prongs branches off a second side face of the carrier. The second pair of prongs is designed to retain a fluid injector and to be coupled mechanically to a first protrusion of the fluid injector. A pair of pins branches off a respective prong from the second pair of prongs at a respective inner side face of the respective prong. The pins are arranged opposed to each other and in a given distance from each other and they are designed to be in a mechanical engagement with the fluid injector. A clamping device is designed to couple mechanically with the fluid injector cup in order to exert a repelling force on the fluid injector cup.

This enables a simple fastening element which can be mechanically coupled to the fluid injector and the fluid injector cup in a precise manner providing, for example, an anti-rotation feature.

In an embodiment, the clamping device comprises a third pair of prongs branching off the first side face of the carrier in a given angle and being designed to retain the fluid injector cup. This contributes to avoid vibrations between the fluid injector and the fluid injector cup. The higher the pressure of a fluid in the fluid injector cup and in the fluid injector the bigger is the likelihood of vibrations if there are no means preventing them. As a result, the fastening device can be used for example in high pressure fluid injector assemblies.

In a further embodiment, the prongs of the first pair of prongs comprise a respective protrusion at the end of a respective free axial end being designed to couple to the protrusion of the fluid injector cup in a snap fit engagement. This enables a reliable mechanical coupling between the fastening element and the fluid injector cup.

In a further embodiment, the given angle is about 90°. This enables a reliable mechanical coupling of the fastening element with the fluid injector, for example with a notch of the fluid injector.

In a further embodiment the fastening element is made of stainless steel. This enables simply a reliable and durable fastening element having a long life time.

According to a second aspect, a fluid injector assembly may comprise the fluid injector cup with the protrusion. The fluid injector comprises a housing with the first protrusion and a second protrusion. The fastening element is mechanically coupled with the fluid injector cup and the fluid injector. The protrusion of the fluid injector cup is in a mechanical engagement with the first pair of prongs. The first protrusion of the housing is mechanically coupled to the second pair of prongs and is arranged between the two prongs from the second pair of prongs. The second protrusion is in a mechanical engagement with the pair of pins.

The fastening element of the fluid injector assembly is designed to prevent the fluid injector from rotating relative to the fluid injector cup. In particular, the mechanical engagement of the first pair of prongs with the protrusion of the fluid injector cup and the pair of pins with the second protrusion of the fluid injector can prevent a rotation between the fluid injector and the fluid injector cup. This enables a reliable fluid injector assembly and contributes to a precise positioning of the fluid injector relative to the fluid injector cup.

In an embodiment the protrusion of the fluid injector cup has a different width than the second protrusion of the fluid injector. This enables a reliable fluid injector assembly with a fastening element being mechanically coupable to the fluid injector and to the fluid injector cup in a predetermined direction.

According to a third aspect, a fluid injector cup is hydraulically coupled with the protrusion and the fluid injector and a housing may be provided with the first protrusion and the notch. The fastening element is mechanically coupled with the fluid injector cup and the fluid injector. The protrusion of the fluid injector cup is in a mechanical engagement with the first pair of prongs. The first protrusion of the housing is mechanically coupled to the second pair of prongs and is arranged between the two prongs and the second pair of prongs. The pair of pins is mechanically coupled with a respective lateral side face of the notch.

The fastening element of the fluid injector assembly is designed to prevent the fluid injector from rotating relative to the fluid injector cup. In particular, the mechanical engagement of the first pair of prongs with the protrusion of the fluid injector cup and the pair of pins with the notch of the fluid injector can prevent a rotation between the fluid injector and the fluid injector cup. This enables a reliable fluid injector assembly and contributes to a precise positioning of the fluid injector relative to the fluid injector cup.

FIG. 1 shows a fastening element with a carrier 2 and a first pair of prongs 4, a second pair of prongs 6 and a third pair of prongs 8. The first pair of prongs 4 branches off a first side face of the carrier 2. The second pair of prongs 6 branches off a second side face of the carrier which is opposed to the first side face of the carrier 2. The third pair of prongs 8 branches off the first side face of the carrier 2 in a given angle relative to first pair of prongs 4. The given angle can be, for example, between 10 and 45 degrees. However, the given angle depends on the given spring load. Hence, the given angle can also be of another value.

A pair of pins 10 branches off a respective prong from the second pair of prongs 6 at a respective inner side face of the respective prong such that the pins from the pair of pins 10 are arranged opposed to each other and in a given distance from each other.

In an embodiment, each of the prongs of the first pair of prongs 4 comprises a projection 12. In this way, the fastening element can establish a snap fit engagement with the protrusion 24 of the fluid injector cup 14 which enables a reliable mechanical coupling between the fastening element and the fluid injector cup 14.

Figure 2:
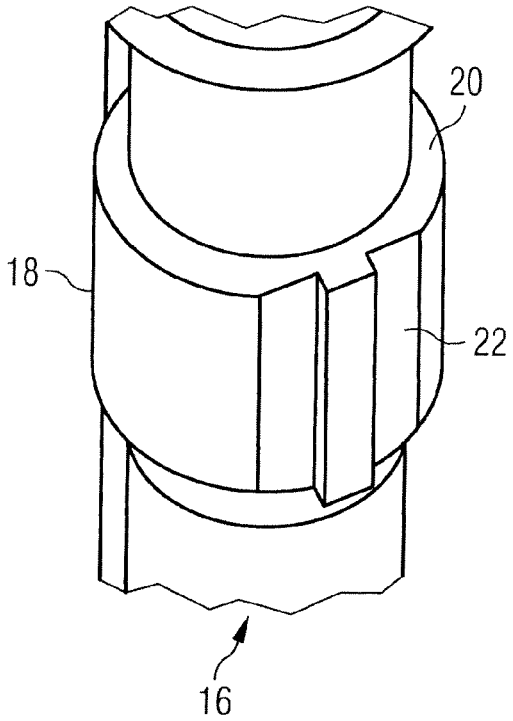
FIG. 2 a section of a fluid injector with a first protrusion and a second protrusion, FIG. 3 a first aspect of a fluid injector assembly, FIG. 4 the first aspect of the fluid injector assembly shown from a second perspective, FIG. 5 the first aspect of the fluid injector assembly shown from a third perspective, FIG. 6 a second aspect of the fluid injector assembly, FIG. 7 the second aspect of the fluid injector assembly shown from a second perspective, FIG. 8 the second aspect of the fluid injector assembly shown from a third perspective.

FIG. 2 shows a section of a fluid injector 16 with a housing 18 comprising a first protrusion 20 and a second protrusion 22. The first protrusion 20 can, for example, be a circumferential protrusion and the second protrusion 22 can, for example, be an axial protrusion, as it is shown in FIG. 2. The fluid injector 16 can be designed to be a fuel injector and arranged in order to dose fuel into a combustion chamber of a combustion engine. The housing 18 of the fluid injector 16 is designed to be coupled mechanically to the fastening element.

Figure 3:
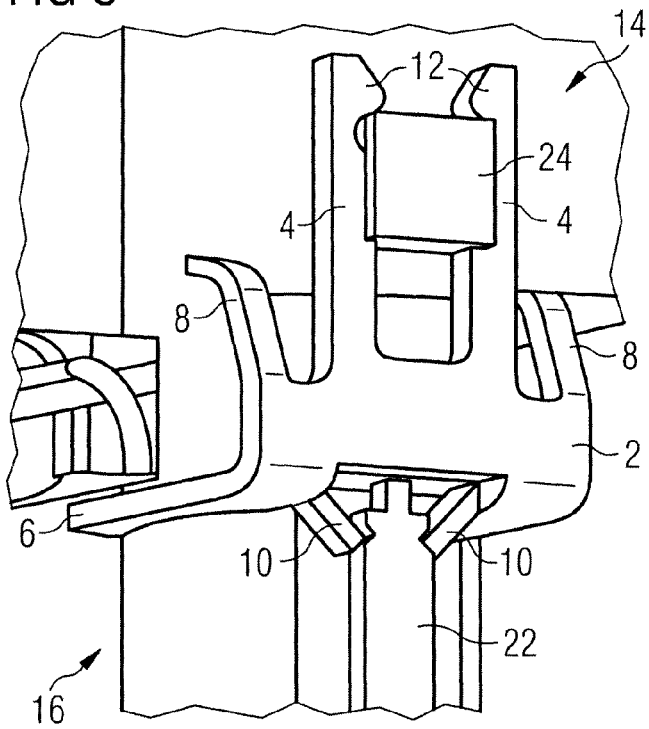

FIG. 3 shows a first aspect of a fluid injector assembly from a first perspective. The fastening element is mechanically coupled to the fluid injector 16 and to the fluid injector cup 14. The first pair of prongs 4 is mechanically coupled to a protrusion 24 of the fluid injector cup 14. The projections 12 of the first pair of prongs 4 are in a snap fit engagement with the protrusion 24 of the fluid injector cup 14. The second pair of prongs 6 rests on the first protrusion 20. Each of the pins from the pair of pins 10 is in a mechanical engagement with the second protrusion 22.

The third pair of prongs 8 is in a mechanical engagement with the fluid injector cup 14. The third pair of prongs 8 can also be called a clamping device 8, as it exerts a repelling force on the fluid injector cup 14. In an embodiment, the prongs of the third pair of prongs 8 are bended several times, for example twice. As a result, the prongs from the third pair of prongs 8 couple mechanically with the fluid injector cup 14 on a lateral side face and not with a respective free axial end. This enables a clamping mechanism. The clamping device 8 can comprise, for example instead of the third pair of prongs 8, a spring element. The clamping device 8 can also comprise, for example, any other device which enables to exert a repelling force between the fluid injector 16 and the fluid injector cup 14. The clamping device 8 can prevent vibrations between the fluid injector 16 and the fluid injector cup 14 which are especially likely to appear in high pressure fluid injector assemblies. The clamping device 8 can, for example, exert forces of 200 to 1000 N on the fluid injector cup 14. This may prevent vibrations for example in direct injection combustion engines running at fuel pressures of between 40 and 200 bar, for example. Other values for the exerted force may be possible.

Figure 4:
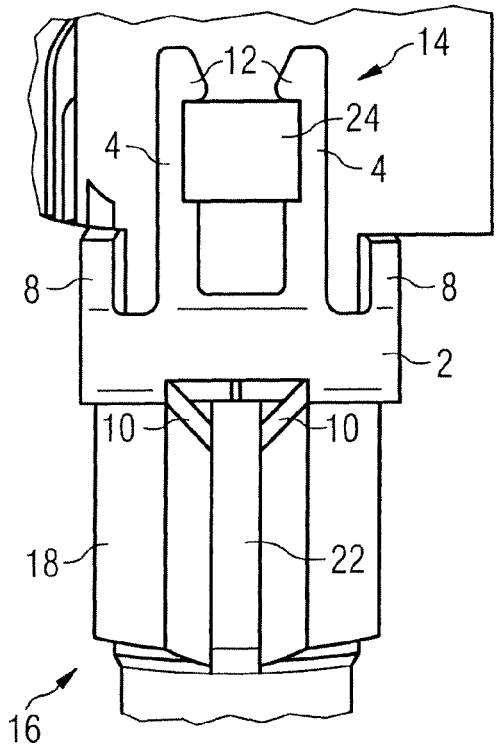
Figure 5:
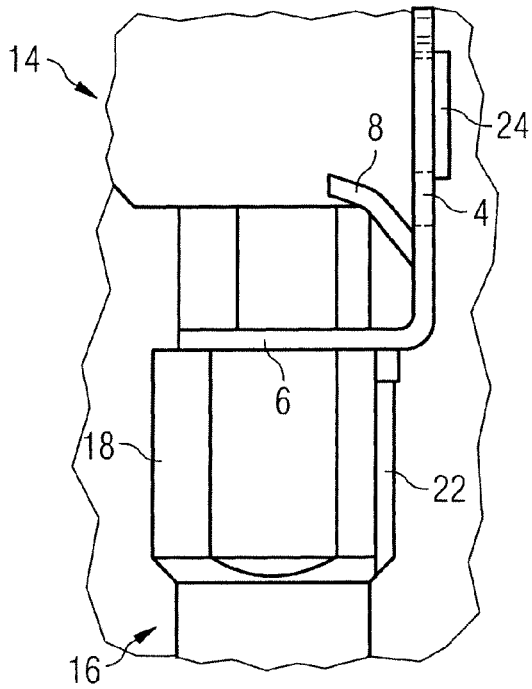

FIG. 4 and FIG. 5 show the first aspect of the fluid injector assembly from a second and third perspective respectively. In an embodiment, the protrusion 24 of the fluid injector cup 14 has got a different width than the second protrusion 22 of the fluid injector 16. This enables a fail safe design of the fastening element. The reason is that the fastening element only establishes the intended mechanical engagement with the fluid injector 16 and the fluid injector cup 14 if it is mounted in the predetermined direction. If being mounted in a direction which differs from the predetermined direction it is not possible, for example, to establish a snap fit engagement with the protrusion 24 of the fluid injector cup 14. This can be easily noticed, for example by a responsible technician.

Figure 6:
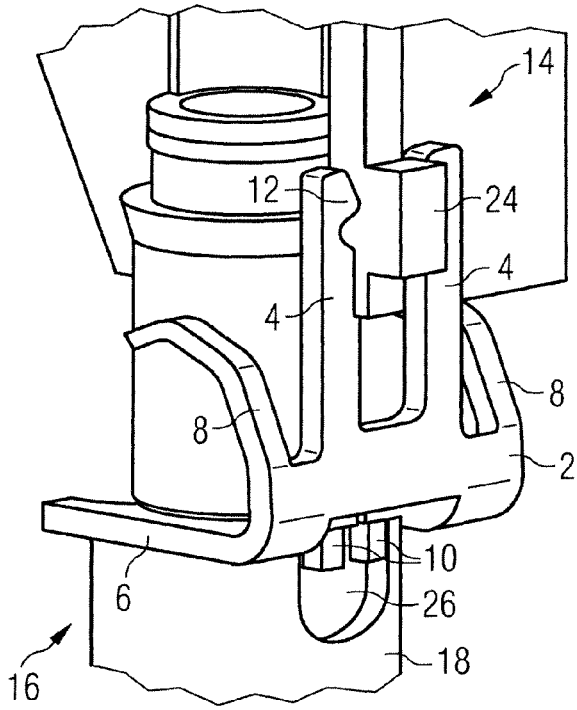

FIG. 6 shows a second aspect of the fluid injector assembly. The second aspect of the fluid injector assembly corresponds to the first aspect of the fluid injector assembly. A difference is that for the second aspect of the fluid injector assembly, the housing 18 of the fluid injector 16 comprises a notch 26 instead of the second protrusion 22. The pair of pins 10 is mechanically coupled with the fluid injector 16 at a respective lateral side of the notch 26. In an embodiment, the pair of pins 10 is arranged perpendicular to the second pair of prongs 6 and in parallel to the respective lateral side of the notch 26.

Figure 7:
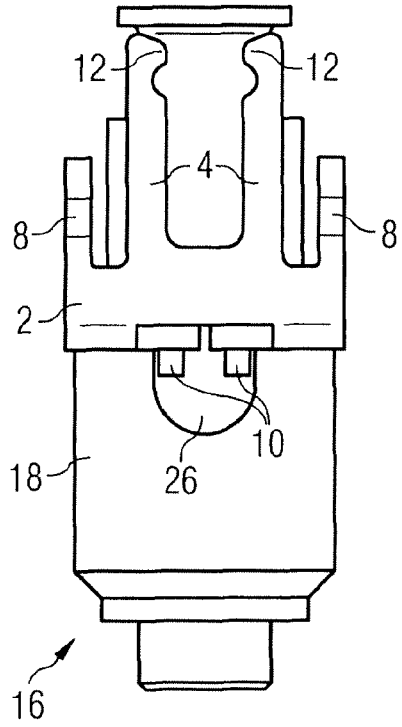

FIG. 7 shows the second aspect of the fluid injector assembly from a second perspective without the fluid injector cup 14. The combination of the notch 26 of the fluid injector 16 and the protrusion 22 of the fluid injector cup 14 imposes the fastening element to be mechanically coupled to the fluid injector 16 and the fluid injector cup 14 in a given direction. If the fastening element is mounted, for example by the technician of an original equipment manufacturer, in a direction which is different from the predetermined direction, the fastening element does not establish the snap fit engagement with the protrusion 24 of the fluid injector cup 14. Such a design with the fastening element being mechanically couplable in a given direction only is also referred to as a "fail-safe" design. In manufacturing, a design having such a feature is also addressed with the Japanese expression "poka yoke".

Figure 8:
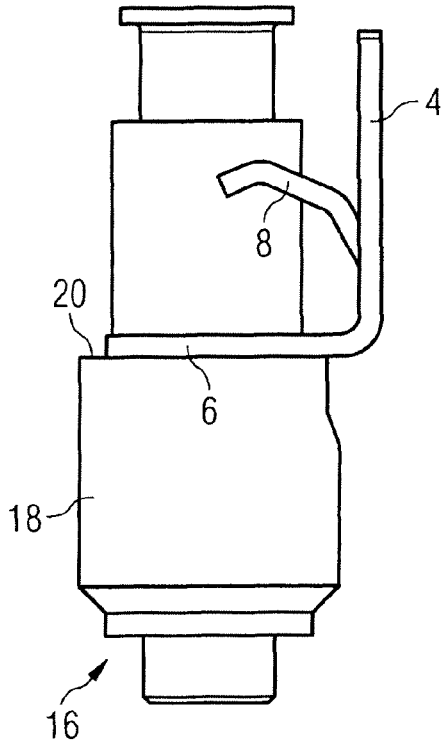

FIG. 8 shows the second aspect of the fluid injector assembly from a third perspective. The fluid injector cup 14 is not shown on FIG. 8. The second pair of prongs 6 rests on the first protrusion 26 of the housing 8 of the fluid injector 16. Perpendicular to the second pair of prongs 6 is arranged the first pair of prongs 4. Arranged in the given angle relative to the first pair of prongs 4 is the third pair of prongs 8.

In an embodiment, the fastening element is made of steel, preferably stainless steel. This enables simply a reliable and durable fastening element with a long life time.

What is claimed is:

1. A fastening element, comprising:

a carrier, a first pair of prongs branching off a first side face of the carrier operable to mechanically engage with a protrusion of a fluid injector cup, a second pair of prongs branching off a second side face of the carrier operable to retain a fluid injector and to couple mechanically to a first protrusion of the fluid injector, a pair of pins branching off a respective prong from the second pair of prongs at a respective inner side face of the respective prong, the pins opposed to each other and at a given distance from each other and operable to mechanically engage with the fluid injector, and a clamping device operable to couple mechanically with the fluid injector cup and to exert a repelling force on the fluid injector cup.

2. The fastening element according to claim 1, wherein the clamping device comprises a third pair of prongs branching off the first side face of the carrier at a given angle and operable to retain the fluid injector cup.

3. The fastening element according to claim 1, wherein the prongs of the first pair of prongs comprise a respective projection at the end of a respective free and operable to couple to the protrusion of the fluid injector cup in a snap fit engagement.

4. The fastening element according to claim 2, further comprising the given angle being about 90°.

5. The fastening element according to claim 1, further comprising the fastening element being made of stainless steel.

6. A fluid injector assembly comprising:

a fluid injector cup with a protrusion, a fluid injector with a housing having a first protrusion and a second protrusion, and a fastening element comprising:

a carrier, a first pair of prongs branching off a first side face of the carrier in mechanical engagement with the protrusion of the fluid injector cup, a second pair of prongs branching off a second side face of the carrier retaining the fluid injector and coupled mechanically to the first protrusion of the fluid injector, a pair of pins branching off a respective prong from the second pair of prongs at a respective inner side face of the respective prong such that the pins are arranged opposed to each other and a given distance from each other and in mechanical engagement with the fluid injector, and a clamping device being designed to couple mechanically with the fluid injector cup and to exert a repelling force on the fluid injector cup.

7. The fluid injector assembly according to claim 6, further comprising the protrusion of the fluid injector cup having a different width than the second protrusion of the fluid injector.

8. The fluid injector assembly according to claim 6, wherein the clamping device comprises a third pair of prongs branching off the first side face of the carrier in a given angle and being designed to retain the fluid injector cup.

9. The fluid injector assembly according to claim 6, wherein the prongs of the first pair of prongs comprise a respective projection at the end of a respective free and are designed to couple to the protrusion of the fluid injector cup in a snap fit engagement.

10. The fluid injector assembly according to claim 8, further comprising the given angle being about 90°.

11. The fluid injector assembly according to claim 6, further comprising the fastening element being made of stainless steel.

12. A fluid injector assembly comprising:

a fluid injector cup with a protrusion, a fluid injector being hydraulically coupled to the fluid injector cup and having a housing with a first protrusion and a notch, and a fastening element, comprising:

a carrier, a first pair of prongs branching off a first side face of the carrier in mechanical engagement with the protrusion of the fluid injector cup, a second pair of prongs branching off a second side face of the carrier retaining the fluid injector and coupled mechanically to the first protrusion of the fluid injector, a pair of pins branching off a respective prong from the second pair of prongs at a respective inner side face of the respective prong such that the pins are arranged opposed to each other and a given distance from each other and in mechanical engagement with the fluid injector, and a clamping device coupled mechanically with the fluid injector cup and exerting a repelling force on the fluid injector cup, wherein the pair of pins is mechanically coupled with a respective lateral side face of the notch.

13. The fluid injector assembly according to claim 12, wherein the clamping device comprises a third pair of prongs branching off the first side face of the carrier in a given angle and being designed to retain the fluid injector cup.

14. The fluid injector assembly according to claim 12, wherein the prongs of the first pair of prongs comprise a respective projection at the end of a respective free and are designed to couple to the protrusion of the fluid injector cup in a snap fit engagement.

15. The fluid injector assembly according to claim 13, further comprising the given angle being about 90°.

16. The fluid injector assembly according to claim 12, further comprising the fastening element being made of stainless steel.

17. A fastening element, comprising:

a carrier, a first pair of prongs branching off a first side face of the carrier being designed to be in a mechanical engagement with a protrusion of a fluid injector cup, a second pair of prongs branching off a second side face of the carrier is designed to retain a fluid injector and to couple mechanically to a first protrusion of the fluid injector, a pair of pins branching off a respective prong from the second pair of prongs at a respective inner side face of the respective prong such that the pins are arranged opposed to each other and in a given distance from each other and that they are designed to be in a mechanical engagement with the fluid injector, and a clamping device being designed to couple mechanically with the fluid injector cup and to exert a repelling force on the fluid injector cup; and wherein the pair of pins extends from the respective inner side faces of the respective prongs in the opposite direction of the first pair of prongs.

18. A fastening element, comprising:

a carrier;

a first pair of prongs branching off a first side face of the carrier operable to mechanically engagement with a protrusion of a fluid injector cup;

a second pair of prongs branching off a second side face of the carrier operable to retain a fluid injector and to couple mechanically to a first protrusion of the fluid injector;

the second pair of prongs including a bearing surface operable to adjoin the first protrusion of the fluid injector;

a pair of pins branching off a respective prong from the second pair of prongs at a respective inner side face of the respective prong such that the pins are arranged opposed to each other and in a given distance from each other and that they are designed to be in a mechanical engagement with the fluid injector;

the pair of pins extending at an angle with respect to the bearing surface of the second pair of prongs; and a clamping device being designed to couple mechanically with the fluid injector cup and to exert a repelling force on the fluid injector cup.

* * * * *